US009604268B2

(12) United States Patent
Duan

(10) Patent No.: US 9,604,268 B2
(45) Date of Patent: Mar. 28, 2017

(54) COLD STATE METAL PLATE STRIP SURFACE TREATMENT SYSTEM AND TREATMENT METHOD OF THE SAME

(71) Applicant: BAOSHAN IRON & STEEL CO., LTD., Shanghai (CN)

(72) Inventor: Mingnan Duan, Shanghai (CN)

(73) Assignee: BAHOSHAN IRON & STEEL CO., LTD., Shanghai (CN)

( * ) Notice: Subject to any disclaimer, the term of this patent is extended or adjusted under 35 U.S.C. 154(b) by 0 days.

(21) Appl. No.: 14/382,086

(22) PCT Filed: May 17, 2013

(86) PCT No.: PCT/CN2013/075789
§ 371 (c)(1),
(2) Date: Feb. 10, 2015

(87) PCT Pub. No.: WO2013/174232
PCT Pub. Date: Nov. 28, 2013

(65) Prior Publication Data

US 2015/0143862 A1 May 28, 2015

(30) Foreign Application Priority Data

May 25, 2012 (CN) ..... 2012 1 0165950

(51) Int. Cl.
*B21B 45/08* (2006.01)

(52) U.S. Cl.
CPC ..... *B21B 45/08* (2013.01)

(58) Field of Classification Search
CPC ..... B21B 45/04; B21B 45/06; B21B 45/08
(Continued)

(56) References Cited

U.S. PATENT DOCUMENTS 2,318,432 A * 5/1943 Stanier et al. ..... 29/81.03
3,543,775 A 12/1970 Bodnar
(Continued)

FOREIGN PATENT DOCUMENTS

CN 1864880 A 11/2006
CN 102172835 A * 9/2011
(Continued)

OTHER PUBLICATIONS

PCT International Search Report, PCT/CN2013/075789, Aug. 29, 2013, 5 pages.

*Primary Examiner* — Debra Sullivan
(74) *Attorney, Agent, or Firm* — Quarles & Brady LLP

(57) ABSTRACT

A cold state metal plate strip surface treatment system and a treatment method thereof, used for high-pressure jet-flow descaling and rinsing metal plate strips, includes a high-pressure jet-flow descaling section. A tension unit and a stabilizing roller are provided in front of the high-pressure jet-flow descaling section, and a stabilizing roller, a compressed air drying device and a tension unit are provided after the high-pressure jet-flow descaling section; at least one descaling unit is provided in the high-pressure jet-flow descaling section, wherein the descaling unit includes first and second bending rollers used for bending a metal plate strip, and correspondingly first and second jet-flow descaling nozzles, and first and second rinsing nozzle sets. The present invention can be used for replacing the prior cold state continuous descaling pickling sets for metal plate strip, to meet the requirements of the rapidness and continuousness of modern cold-state metal plate strip, without affecting the original productivity of the production line. The present invention not only performs the synchronous and continuous descaling for both obverse and reverse surfaces of the metal
(Continued)

plate strips, but also meets the requirements for the plate surfaces in the following procedure.

11 Claims, 1 Drawing Sheet

(58) Field of Classification Search
USPC ..... 72/39, 40
See application file for complete search history.

(56) References Cited

U.S. PATENT DOCUMENTS

| | | | | |
|---|---|---|---|---|
| 5,388,602 | A | 2/1995 | Coassin et al. | |
| 6,389,666 | B1 * | 5/2002 | Grothe | 29/81.08 |
| 2008/0108281 | A1 | 5/2008 | Voges et al. | |
| 2008/0182486 | A1 | 7/2008 | Voges | |
| 2009/0227184 | A1 | 9/2009 | Voges et al. | |

FOREIGN PATENT DOCUMENTS

| | | | |
|---|---|---|---|
| CN | 102189135 | A | 9/2011 |
| DE | 19900427 | A1 | 7/2000 |
| EP | 1900449 | A1 | 3/2008 |
| JP | S5293634 | A | 8/1977 |
| JP | S555156 | A | 1/1980 |
| JP | S5534688 | A | 3/1980 |
| JP | S5768217 | A | 4/1982 |
| JP | S57142710 | A | 9/1982 |
| JP | S5997711 | A | 6/1984 |
| JP | H01154816 | A | 6/1989 |
| JP | H02108508 | A | 4/1990 |
| JP | H0592231 | A | 4/1993 |
| JP | H06108277 | A | 4/1994 |
| JP | H06315712 | A | 11/1994 |
| JP | H0985329 | A | 3/1997 |
| JP | 2000202518 | A | 7/2000 |
| JP | 2002102915 | A | 4/2002 |
| KR | 20040059267 | A | 7/2004 |
| KR | 100928820 | B1 | 11/2009 |

* cited by examiner

COLD STATE METAL PLATE STRIP SURFACE TREATMENT SYSTEM AND TREATMENT METHOD OF THE SAME

CROSS-REFERENCE TO RELATED APPLICATIONS

This application represents the national stage entry of PCT International Application No. PCT/CN2013/075789 filed May 17, 2013, which claims priority of Chinese Patent Application No. 201210165950.0, filed May 25, 2012, the disclosures of which are incorporated by reference here in their entirety for all purposes.

FIELD OF THE INVENTION

The present invention relates to the field of surface treatment for metal plate strip, and in particular to a cold state metal plate strip surface treatment system and a treatment method thereof used for continuously descaling whole surfaces of cold state metal plate strip. The present invention can improve effectively the efficiency of jet-flow descaling and effect stability thereof. In the present invention, front and back tensioning devices are employed to provide enough tension force to metal plate strips, and bending roller sets arranged on the obverse and reverse surfaces of the plate strip are utilized for bending the plate strip in the obverse and reverse directions respectively, then the tensed surface of the bended plate strip is sprayed for descaling and immediately is rinsed by water. Through repeated treatments in several such units, the present invention not only performs the synchronous and continuous descaling for both obverse and reverse surfaces of the metal plate strips, but also keeps both surfaces of the descaled metal plates dry by using compressed air to blow the surfaces thereof, so as to meet the requirements for the plate surfaces in the following procedure.

BACKGROUND OF THE INVENTION

Metal materials, during hot rolling or heat treatment, can form a layer of compact covering on the surfaces thereof, known as "scales". The existing of the scales can affect further processes in the following way:

On the one hand, the surface cracks on the metal materials are difficult to find earlier, such that quality problems exist on the finished products; on the other hand, the scales are prone to pressing into the metal surfaces so as to cause quality problems thereon. Additionally, hard oxides on the surfaces can accelerate the wearing of rollers or drawing machines. Therefore, descaling the surfaces of the steel plate before it entering cold roller is one of the necessary procedures in a cold rolling production line.

Aiming at the effects of the surface scales on metal materials, manufacturing enterprises in China and other countries utilize chemical hydrometallurgy to eliminate the attached scales on the surfaces of the metal plate strip. For steel plates, highly acidic solutions, like sulfuric acid, hydrochloric acid and hydrofluoric acid, are typically used. However, the pickling process with chemical hydrometallurgy is exposed to a severely-polluted manufacturing environment, and has to perform cycle regenerative procedure for the mass residual acids produced during manufacturing, which, inevitably, generates corresponding emission of waste gas including large quantity of acidic and corrosive components like HCL, SO2, which leads to direct atmosphere pollution.

Based on the fact, to solve the aforementioned severe pollution problems caused by the chemical washing method, much researches are conducted and several techniques are developed to replace the chemical methods so as to eliminate scales on the metal surfaces. For instance, electrolytic descaling are used, which includes descaling methods like electrolytic grind descaling, electric discharging descaling, electron beam descaling, laser descaling, grind descaling, shot blasting descaling, alternating bend descaling, and the combination of the above different methods. Among these methods, the high-pressure jet-flow descaling technology is the fastest-growing one, and the industrialization course thereof is becoming more obvious.

However, this jet-flow method, due to its special descaling way, may cause following primary problems on the descaled surfaces:

1) because the jet flow eliminates the scales on the metal plates directly, the shaking of the plates, and the uneven scales and the like therewith, may directly result in the inconformity of descaling effects.

2) the descaling speed is low, and cannot be promoted revolutionarily.

Through looking up related patents, it is found that in metallurgy technology-developed countries, such as Japan, Germany, although many patents or patent applications for continuous jet-flow, grinding-brush descaling technologies are proposed, for instance, JP06108277A discloses a descaling process which combines spraying acids with brush rollers in continuous cold rolling line, JP55034688A discloses a descaling way which combines PV roll broking scales with mixed abrasive high-pressure jet-flow descaling, and JP57142710A, JP57068217A, JP59097711A in Japan and US20080108281(A1), US20080182486(A1), US20090227184(A1), etc. of Canadian TMV company discloses a series of steel plate surface descaling technologies after 2001; besides, patents or patent applications such as American US5388602, Japanese JP05092231A, JP09085329A and JP2002102915, the treatment effectiveness of metal plates after jet-flow descaling still needs to improve.

SUMMARY OF THE INVENTION

Aiming at the aforementioned problems, the objective of the present invention is to provide a novel cold state metal plate strip surface treatment system and a treatment method thereof used for high-pressure jet-flow descaling and rinsing for metal plate strips, which provides tensioning units, bending roller set units, spraying units, and rinsing units so as to synchronously and rapidly descale the obverse and reverse surfaces of strips effectively.

According to the cold state metal plate strip surface treatment system and a treatment method thereof in the present invention, front and back tensioning devices are employed to provide enough tension force to metal plate strip, and bending roller sets arranged on the obverse and reverse surfaces of the plate strip are utilized for bending the plate strip in the obverse and reverse directions, then the tensed surface of the bended plate strip is sprayed for descaling and immediately is rinsed by water. Through repeated treatments in several such units, the present invention not only performs the synchronous and continuous descaling for both obverse and reverse surfaces of the metal plate strips, but also keeps both surfaces of the descaled metal plates dry by using compressed air to blow the surfaces thereof, so as to meet the requirements for the plate surfaces in the following procedure.

To achieve the aforementioned objective, the technical solution of the cold state metal plate strip surface treatment system of the present invention is as follows:

a cold state metal plate strip surface treatment system, used for high-pressure jet-flow descaling and rinsing metal plate strips, includes a high-pressure jet-flow descaling section 6, characterized in that, a tension unit and a stabilizing roller 21 are provided in front of the high-pressure jet-flow descaling section 6, and a stabilizing roller 22, a compressed air drying device 7 and a tension unit are provided after the high-pressure jet-flow descaling section 6;

at least one descaling unit is provided in the high-pressure jet-flow descaling section 6, wherein the descaling unit includes:

first and second bending rollers 51, 52 used for bending a metal plate strip 8, and correspondingly first and second jet-flow descaling nozzles 31, 32, and first and second rinsing nozzle sets 41, 42.

The tensioning unit is a tension roller set 1, which is employed for tensioning the metal plate strip 8 during this procedure, so as to reach the predetermined tension level. The stabilizing rollers are used for keeping the plate stable when the metal plate strip 8 enters the high-pressure jet-flow descaling section 6 and when it exits therefrom. The two bending rollers in the high-pressure jet-flow descaling section 6 are, respectively, the bending roller 51 for bending the metal plate strip 8 upward, and the bending roller 52 for bending the metal plate strip 8 downward. The compressed air drying device 7 is used for blowing and drying the obverse and reverse surfaces of the metal plate strip 8.

A cold state metal plate strip surface treatment system according to the present invention, characterized in that, the high-pressure jet-flow descaling section 6 is provided with two descaling units, that is, a first descaling unit 6-1 and a second descaling unit 6-2.

A cold state metal plate strip surface treatment system according to the present invention, characterized in that, the second bending roller 52 is disposed in a contrast way to the first bending roller 51, and there is a height difference between the surface height of the second bending roller 52 and that of the stabilizing roller 21, which ranges typically between 1 mm-50 mm, preferably, 20 mm.

A cold state metal plate strip surface treatment system according to the present invention, characterized in that, the roller diameter of the first and second bending rollers 51, 52 varies depending on the specifications of the metal plate strip 8, and the outer roller diameter thereof is typically 50 mm-500 mm.

The objective of the present invention is also to provide a cold state metal plate strip surface treatment method, which utilizes the aforementioned cold state metal plate strip surface treatment system for high-pressure jet-flow descaling and rinsing metal plate strips, including a high-pressure jet-flow descaling section 6, characterized in that:

a tension unit and a stabilizing roller 21 are provided in front of the high-pressure jet-flow descaling section 6, and a stabilizing roller 22, a compressed air drying device 7 and a tension unit are provided after the high-pressure jet-flow descaling section 6;

at least one descaling unit is provided in the high-pressure jet-flow descaling section 6, wherein the descaling unit includes:

first and second bending rollers 51, 52 used for bending a metal plate strip 8, and correspondingly first and second jet-flow descaling nozzles 31, 32, and first and second rinsing nozzle sets 41, 42.

The metal plate strip 8, after being tensioned by the tensioning units, enters the descaling unit; after being bended by the first and second bending rollers 51, 52, and going through the corresponding first and second jet-flow descaling nozzles 31, 32, and the first and second rinsing nozzles 41, 42, the scales on the upper and lower surfaces thereof are eliminated synchronously.

A cold state metal plate strip surface treatment method according to the present invention, the temperature of the cold rolling metal plate strip 8 is not more than 200° C.

A cold state metal plate strip surface treatment method according to the present invention, characterized in that, the bending roller 52 is disposed in a contrast way to the unilateral bending roller 51, and there is a height difference between the surface height of the unilateral bending roller 52 and that of the stabilizing roller 21.

A cold state metal plate strip surface treatment method according to the present invention, characterized in that, the tension force per unit on the metal plate strip 8 provided by the tensioning unit 1 is typically between 0.1 Mpa-100 Mpa.

A cold state metal plate strip surface treatment method according to the present invention, characterized in that, the roller diameter of the first and second bending roller 51, 52 varies depending on the specifications of the metal plate strip 8, and the outer roller diameter thereof is typically 50 mm~500 mm;

A cold state metal plate strip surface treatment method according to the present invention, characterized in that, the first and second jet-flow descaling nozzle units 31, 32 are high-pressure jet-flow nozzles, which typically include at least one kind of jet medium, and the medium at least includes water ($H_2O$) and hard sandy particles.

The hard sandy particles, in detail, can include and be selected from metal processing shots, such as natural corundum grinding materials (e.g. brown corundum, white corundum, monocrystalline corundum), carbide grinding materials (e.g. black silicon carbide, green silicon carbide, boron carbide), steel shot, cut wire shot and the like.

A cold state metal plate strip surface treatment method according to the present invention, characterized in that, the particle size and jet pressure of the first and second jet-flow descaling nozzle units 31, 32 varies slightly depending on the jet objects, wherein the jet pressure of the water medium is 5 Mpa~80 Mpa, and the size of the hard sandy particles is 10 meshes~120 meshes.

The jet medium of the first and second rinsing nozzles 41, 42 is typically a single medium, water, which should meet the standards of clean circulating water of the factory, and has a temperature of less than 100° C., PH of 6.5-9, and a jet pressure level of typically 0.1 Mpa-5 Mpa.

The jet medium of the compressed air jet unit 7 is single compressed air, which, typically, is dried compressed air, and has a pressure of 0.01 Mpa-10 Mpa.

The devices are shown with reference to FIG. 1-FIG. 3.

The cold state metal plate strip surface treatment system and the treatment method thereof according to the present invention, can be used for replacing the prior cold state continuous descaling pickling sets for metal plate strip, to meet the requirements of the rapidness and continuousness of modern cold-state metal plate strip, without affecting the original productivity of the production line. The present invention not only performs the synchronous and continuous descaling for both obverse and reverse surfaces of the metal plate strips, but also keeps both surfaces of the descaled metal plates dry by using compressed air to blow the surfaces thereof, so as to meet the requirements for the plate surfaces in the following procedure.

In the figures, 1 indicates a tensioning unit, 6 indicates a jet-flow descaling section, 21,22 are the first and second stabilizing roller sets respectively, 31,32 are the first and second jet-flow descaling nozzle units respectively, 41,42 are the first and second jet-flow rinsing units respectively, 51, 52 are the first and second side bending rollers respectively, 6-1, 6-2 are the first and second jet-flow descaling units respectively, 7 indicates a compressed air blowing device, 8 a metal plate strip, 9 three tensioning rollers, 10 a uncoiler, 11 a coiler, and 12, 13 other tandem processing sections.

DETAILED DESCRIPTION OF THE INVENTION

With reference to the accompanying drawings, the cold state metal plate strip surface treatment system and a treatment method thereof according to the present invention will be described in detail thereinafter.

Embodiments

Figure 1:
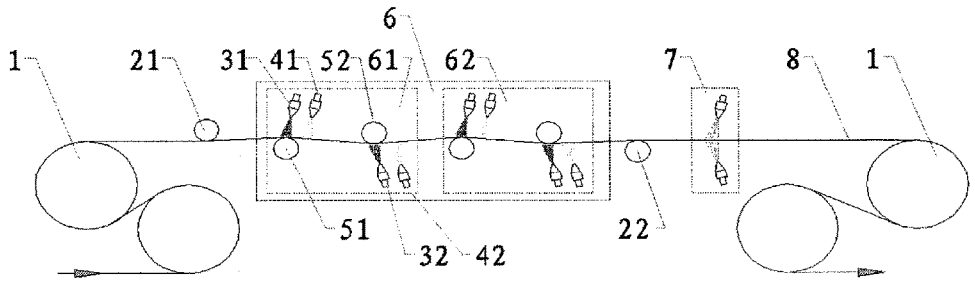
FIG. 1 is a process arrangement drawing of the continuous bending jet-flow descaling disclosed by the application.
Figure 2:
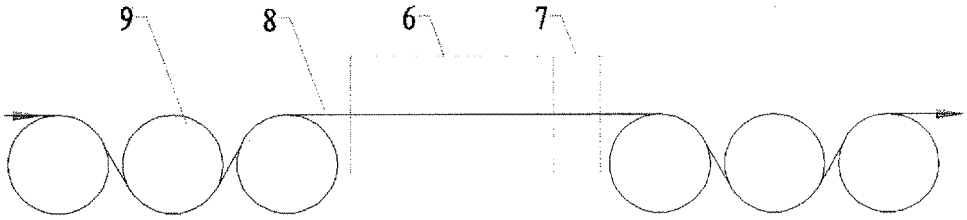
FIG. 2 is a process arrangement drawing using three-roller tension units for tensioning.
Figure 3:
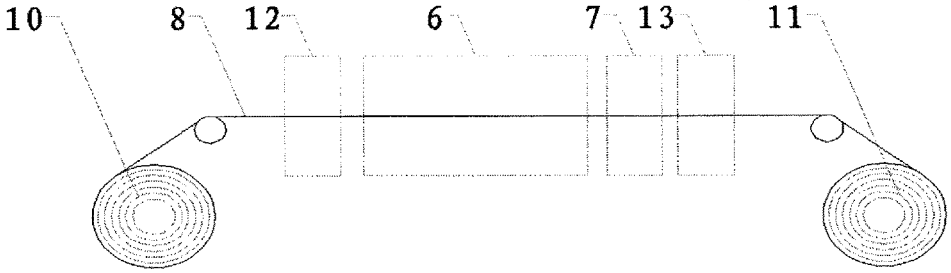
FIG. 3 is a whole process arrangement drawing directly using uncoiler and coiler for tensioning.

As mentioned above, the continuous descaling processing solution is shown in FIGS. 1-3. To guarantee the jet-flow continuous descaling procedure disclosed by the application with good effects, the following measurements are mainly taken:

1) the metal plate strip 8 in the jet-flow descaling unit 6 should keep in a certain tension force;

2) the side bending rollers 51, 52 disposed in the jet-flow descaling unit 6, owing to their own small roller diameter and the height difference of the roller surfaces, ensure that the metal plate strip 8 has a certain wrap angle formed on the roller surface, thereby the attachments on one side of the metal plate strip 8 forms cracks, which is good to the jet-flow descaling;

3) there is disposed with corresponding jet-flow descaling units 31, 32 in the area of both side bending rollers 51, 52, which is used for jet-flow descaling a single side surface of the bended and tensed metal plate strip 8;

4) the jet-flow rinsing units 41, 42 are disposed immediately after each of the jet-flow descaling units 31, 32, which are used for rinsing the surfaces of the descaled metal plate strip 8, and ensure that there is no remarkable hard remainders thereon.

Thereinafter, the application takes the continuous descaling operation of cold state steel plate as examples:

Steel slabs are coiled after being separately rolled by hot roller, and they need to be continuously descaled before entering cold roller. At this time, the steel coils 8 have been continuously end-to-end welded via the equipments disposed before the production line, that is, the steel coils 8 had become a continuous steel plate 8 with an unlimited length before entering the bending roller set 1. The temperature of the steel plate 8 is not more than 200° C., and after entering the tensioning roller set 1, the strip 8 keeps in a tension state under the tension force of the tensioning roller set 1.

In this way, the strip 8, under the effects of the stabilizing roller 21 and the side bending roller 51, are bended and tensed on the upper surface of the side bending roller 51. At this time, the upper surface of the strip 8, under the compound effects of tensioning and bending, cracks slightly, when the mixing jet-flow nozzle 31, driven by the high-pressure water medium mixing with garnets, sprays at the surface of the strip 8, so as to eliminate scales on the upper surface thereof. The descaled strip 8 is, immediately, rinsed by pure water from the rinsing nozzle 41, so as to completely eliminate the scales on the upper surface of the strip 8. In turn, the descaled strip 8 passes through another side bending roller 52, and the lower surface thereof is descaled in the same way.

As a result, after passing through the jet-flow descaling unit 6, both the upper and lower surfaces of the strip 8 are descaled. Then the descaled strip 8 passes through the dry blowing unit 7 which uses dry compressed air with a pressure of 0.5 Mpa to synchronously blow and dry both surfaces of the strip 8, such that the descaled surfaces of the strip 8 are dried, which ensures that the strip 8, while undergoing the following procedures, for example, rolling, coating or the like, would not affect the effects thereof.

With reference to FIG. 1, in the embodiment 1, the strip 8 is tensed by two S-shape roller sets disposed in front and at back thereof, and the strip 8 is hold at the actual height in conformity with the procedure height via two stabilizing roller units 21 and 22 provided within the tensioning unit 1; at the same time, both surfaces of the strip 8 are descaled synchronously by using two sub-units 61, 62 disposed tandem in the jet-flow descaling unit 6, then the descaled strip 8 enters the dry blowing unit 7 to dry the surfaces thereof.

With reference to FIG. 2, in the embodiment 2, the strip 8 is tensed by two three-roller tensioning units disposed in front and at back thereof, and the strip 8 is hold at the actual height in conformity with the procedure height via two stabilizing roller units 21 and 22 provided within the tensioning unit 1; at the same time, both surfaces of the strip 8 are descaled synchronously by using the jet-flow descaling unit 6, and the descaled strip 8 enters the dry blowing unit 7 to dry the surfaces thereof.

With reference to FIG. 3, in the embodiment 3, the strip 8 has its tension force level maintained by a uncoiler unit and a coiler unit disposed in front and at back thereof respectively, and both surfaces of the strip 8 are descaled synchronously by using the jet-flow descaling unit 6, then the descaled strip 8 enters the dry blowing unit 7 to dry the surfaces thereof. In this arrangement, some other devices 12 can be disposed before the jet-flow descaling unit 6, which can include head- and tail shears, welders, loops and the like, and in the meantime, other processing devices 13 can be disposed after the dry blowing unit 7, which can include loops, shears, rollers, coater sets, and the like.

Cold rolling metal plate strip 8 (metal plate strip of a temperature not more than 200° C., e.g. steel plate, aluminum plate, titanium plate, and the like) runs along a roller table to the entry of the tensioning unit 1, and after passing through the entry roller sets of the tensioning roller set 1, it enters the entry stabilizing roller 21, under the stabilizing effects of which, the metal plate strip 8 is hold at a horizontal height as the requirement of the procedure. In turn, the metal plate strip 8 enters the jet-flow descaling unit 6 (that consists of a plurality of subunits 61, 62 etc. with the same device arrangement and functions). After passing through the stabilizing roller 21, the metal plate strip 8, sequentially, enters the first subunit 61 of the jet-flow descaling unit 6, where the metal plate strip 8 needs, first, to pass through the unilateral bending roller 51. There is a certain difference between the upper surface height of the unilateral bending roller 51 and that of the stabilizing roller 21, which directly determines a roller surface wrap angle of the metal plate strip 8 on the unilateral bending roller 51. Meanwhile, the diameter of the unilateral bending roller 51 determines the curvature radius of the metal plate strip 8 when it bends. In this way, after the metal plate strip 8 is hold with a tension force necessary to the procedure, one side surface thereof is bound to become tensed remarkably under the pressing effects of the unilateral bending roller 51, which causes slight cracking and peeling-off of the surface attachments at this side (for example, scales). At this time, the jet-flow descaling nozzle 31 disposed at this side uses high-pressure jet-flow to spray the plate surface on this side so as to eliminate the scales easily. The descaled surface of the metal plate strip 8 is rinsed via the rinsing nozzle 41 disposed at this side in order to remove the surface remainders, such that it is ensured that no attachment exists on this side thereof.

The metal plate strip 8 treated in this way, enters, in turn, another unilateral bending roller 52 of the subunit 61, which is disposed in a just contrary way to the unilateral bending roller 51, and as such, there is a height difference between the roller surface of the unilateral bending roller 52 and that of the stabilizing roller 21. This difference value a2 determines directly a roller surface wrap angle of the metal plate strip 8 on the unilateral bending roller 52. Meanwhile, the diameter of the unilateral bending roller 52 determines the curvature radius of the metal plate strip 8 when it bends. In this way, after the metal plate strip 8 is hold with a tension force necessary to the procedure, one side surface thereof is bound to become tensed remarkably under the pressing effects of the unilateral bending roller 52, which causes slight cracking and peeling-off of the surface attachments at this side (for example, scales). At this time, the jet-flow descaling nozzle 32 disposed at this side, uses high-pressure jet-flow to spray the plate surface on this side so as to eliminate the scales easily. The descaled surface of the metal plate strip 8 is rinsed via the rinsing nozzle 42 disposed at this side in order to remove the surface remainders, such that it is ensured that no attachment exists on this side thereof.

In this way, after the metal plate strip 8 passes completely through two unilateral bending rollers 51, 52, the corresponding jet-flow descaling nozzles 31, 32, and the rinsing nozzles 41, 42, the scales on the upper and lower surfaces of the metal plate strip 8 are removed synchronously.

Also, the jet-flow descaling unit 6 is typically provided tandem with another descaling subunit 62 so as to contribute to more rapid descaling and better effect thereof for the metal plate strip 8.

The tensioning way of the tensioning unit 1 includes, typically, S-roller tensioning, three-roller tensioning (that is, a three-roller tensioning unit is provided respectively at the entry and exit of the metal plate strip 8), and uncoiler-coiler direct tensioning; the tension force per unit provided by the tensioning unit 1 on the metal plate strip 8 is typically 0.1 Mpa~100 Mpa.

The roller diameter of the unilateral bending roller 51, 52 varies depending on the specifications of the metal plate strip 8, and the outer roller diameter thereof is typically 50 mm~500 mm.

The jet-flow descaling nozzle units 31, 32 are high-pressure jet-flow nozzles, which typically include at least one kind of jet medium, and the medium at least includes water ($H_2O$) and hard sandy particles.

The hard sandy particles sprayed by the jet-flow descaling nozzle units 31, 32, in detail, can include metal processing shots, such as natural corundum grinding materials (e.g. brown corundum, white corundum, monocrystalline corundum), carbide grinding materials (e.g. black silicon carbide, green silicon carbide, boron carbide), steel shots, cut wire shots and the like.

The water standard of the water medium sprayed from the jet-flow descaling nozzles 31, 32, is industrial clean circulating water with a normal temperature, which, particularly, can be specified in detail: the temperature thereof is less than 100° C., and PH thereof is 6.5-9.

The particle size and jet pressure of the jet-flow descaling nozzle units 31, 32 varies slightly depending on the jet objects, where the jet pressure of the water medium is typically 5 Mpa~80 Mpa, and the size of the hard sandy particles is typically 10 meshes~120 meshes.

The jet medium of the rinsing nozzles 41, 42 is typically a single-medium, water, which should meet the standards of clean circulating water of the factory, and has a temperature of less than 100° C., PH of 6.5~9, and a jet pressure level of typically 0.1 Mpa~5 Mpa.

The jet medium of the compressed air jet unit 7 is single compressed air, which, typically, is dried compressed air, and has a pressure of 0.01 Mpa-10 Mpa.

As mentioned above, the detailed embodiments of the present invention are described by means of detailed examples, but it should be understood that the detailed description is not intended to limit the principles and scopes of the present invention. The present invention can be adapted to the continuous descaling not only for metal plate strips, but also for metal bars, metal tubes, and metal rods. Various modifications by the skilled after reading the specification, should fall into the protection scope of the present invention.

The cold state metal plate strip surface treatment system and the treatment method thereof according to the present invention, can be used for replacing the prior cold state continuous descaling pickling sets for metal plate strip, to meet the requirements of the rapidness and continuousness of modern cold-state metal plate strip, without affecting the original productivity of the production line. The present invention not only performs the synchronous and continuous descaling for both obverse and reverse surfaces of the metal plate strips, but also keeps both surfaces of the descaled metal plates dry by using compressed air to blow the surfaces thereof, so as to meet the requirements for the plate surfaces in the following procedure. The present invention has promising application prospect in the field of cold rolling production.

The invention claimed is:

1. A cold state metal plate strip surface treatment system, used for high-pressure jet-flow descaling and rinsing metal plate strips, comprises a high-pressure jet-flow descaling section, characterized in that, a tension unit and a stabilizing roller are provided in front of the high-pressure jet-flow descaling section, and a stabilizing roller, a compressed air drying device and a tension unit are provided after the high-pressure jet-flow descaling section;

at least one descaling unit is provided in the high-pressure jet-flow descaling section, wherein the descaling unit comprises:

first and second bending rollers used for bending a metal plate strip, and correspondingly first and second jet-flow descaling nozzles, and first and second rinsing nozzle sets, the second bending roller being disposed on an opposing side of the metal plate strip from the first bending roller and having an outer diameter smaller than that of the stabilizing roller in the front of the descaling section, such that there is an offset in height between an upper surface of the second bending roller and a lower surface of the stabilizing roller in the front of the descaling section between about 1 mm and 50 mm, the offset in height forming a wrap angle bending a surface of the metal plate strip between 1 and 10 degrees, wherein the first and second bending rollers disposed in the jet-flow descaling unit form stress cracks in the metal plate strip, which promotes the jet-flow descaling.

2. The cold state metal plate strip surface treatment system according to claim 1, characterized in that, the high-pressure jet-flow descaling section is provided with two descaling units.

3. The cold state metal plate strip surface treatment system according to claim 1, characterized in that, an outer roller diameter of the first and second bending rollers is correlated to a specification of the metal plate strip, and the outer roller diameter of the first and second bending rollers is typically between about 50 mm and 500 mm.

4. The cold metal plate strip of claim 1, wherein the offset in height between the upper surface of the second bending roller and the lower surface of the stabilizing roller is between 20 mm and 50 mm.

5. The cold metal plate strip of claim 1, wherein the wrap angle bending a surface of the metal plate strip is between 3 and 10 degrees.

6. A cold state metal plate strip surface treatment method for synchronously eliminating scales on upper and lower surfaces of a metal plate strip the method comprising the steps of, bending a metal plate strip with first and second bending rollers, the second bending roller being disposed on an opposing side of the metal plate strip from the first bending roller, tensioning the metal plate strip between at least first and second rollers of a tensioning unit, the steps of bending and tensioning the metal plate strip forming stress cracks in the metal plate strip plate, driving the metal plate strip through a high pressure descaling unit comprising a first jet-flow descaling nozzle and a first rinsing nozzle directed at a first side of the metal plate strip and a second jet-flow descaling nozzle and a second rinsing nozzle directed at a second side of the metal plate strip to descale the metal plate strip, wherein the second bending roller has a diameter smaller than that of a stabilizing roller in the front of the high pressure descaling section, such that there is an offset in height between an upper surface of the second bending roller and a lower surface of the stabilizing roller in the front of the high pressure descaling section between about 1 mm and 50 mm, the offset in height forming a wrap angle bending a surface of the metal plate strip between 1 and 10 degrees.

7. The cold state metal plate strip surface treatment method according to claim 6, further comprising the steps of disposing the first bending roller on the first side of the metal plate strip and the second bending roller on the side opposing the first side of the metal plate strip.

8. The method of claim 6, further comprising the step of tensioning the metal plate strip with a tension force per unit between about 0.1 Mpa and 100 Mpa.

9. The cold state metal plate strip surface treatment method according to claim 6, wherein an outer roller diameter of the first and second bending rollers is between about 50 mm and 500 mm.

10. The cold state metal plate strip surface treatment method according to claim 6, wherein the step of driving the metal plate strip through a high pressure descaling unit further comprises the step of descaling the metal plate strip with a jet medium that comprises at least water and hard sandy particles which comprise mineral particles and metal particles used as abrasive particles and a size of the mineral and the metal particles is between about 10 meshes and 120 meshes.

11. The cold state metal plate strip surface treatment method according to claim 6, wherein the step of driving the metal plate strip through a high pressure descaling unit further comprises the step of descaling the metal strip plate metal plate strip with a water medium having hard sandy particles between about 10 meshes and 120 meshes at a jet pressure of between about 5 Mpa and 80 Mpa.

* * * * *